US005315967A

United States Patent [19]

Schoell

[11] Patent Number: 5,315,967

[45] Date of Patent: May 31, 1994

[54] INTERNAL COMBUSTION ROTARY ENGINE HAVING A STACKED ARRANGEMENT OF CYLINDERS

[76] Inventor: Harry Schoell, 2698 SW. 23rd Ave., Fort Lauderdale, Fla. 33312

[21] Appl. No.: 48,821

[22] Filed: Apr. 16, 1993

[51] Int. Cl.[5] ..... F02B 59/00

[52] U.S. Cl. ..... 123/55 AA; 123/566

[58] Field of Search ..... 123/55 AA, 55 AB, 56 C, 123/566

[56] References Cited

U.S. PATENT DOCUMENTS

| | | | |
|---|---|---|---|
| 1,775,635 | 9/1930 | Ball | 123/55 AA |
| 1,830,046 | 11/1931 | White | 123/55 AA |
| 3,482,554 | 12/1969 | Marthins | 123/55 AA |
| 3,572,209 | 3/1971 | Aldridge | 123/55 AA |
| 4,331,108 | 5/1982 | Collins | 123/55 AA |
| 4,408,577 | 10/1983 | Killian | 123/56 C |
| 4,974,553 | 12/1990 | Murray et al. | 123/55 AA |

*Primary Examiner*—E. Rollins Cross
*Assistant Examiner*—M. Macy
*Attorney, Agent, or Firm*—Brooks & Kushman

[57] ABSTRACT

An internal combustion engine having a crankcase with a crankshaft and cylinders radiating from the crankcase, where the cylinders are circumferentially spaced apart. There are eccentric cams on the crankshaft which contact reciprocating pistons to move them in turn outwardly from the crankshaft. Pressurized air forced into the cylinders moves the pistons inwardly. The pressurized air and fuel are ignited in the cylinder to continue the reciprocation of the piston. Rotary valve tubes with ports supply air to the cylinders. The air is pressurized by a ram air blower. Both the rotary valve tubes and ram air blower are connected to a gear system driven by the crankshaft.

13 Claims, 5 Drawing Sheets

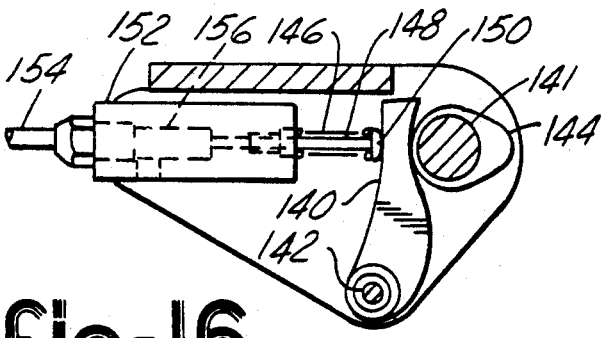
Fig-16
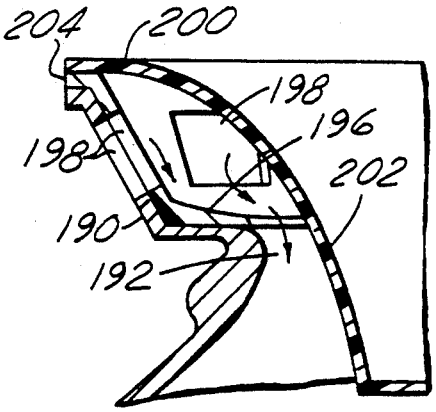
Fig-19
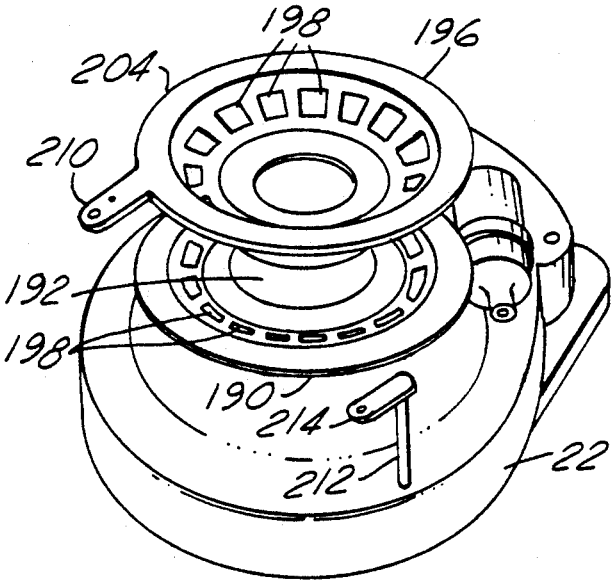
Fig-17
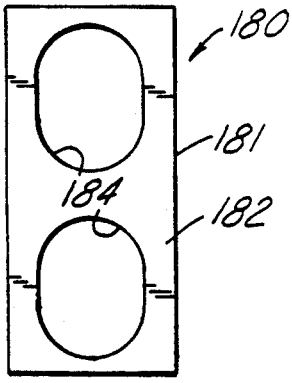
Fig-20
Fig-21
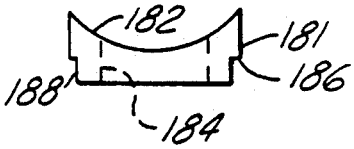
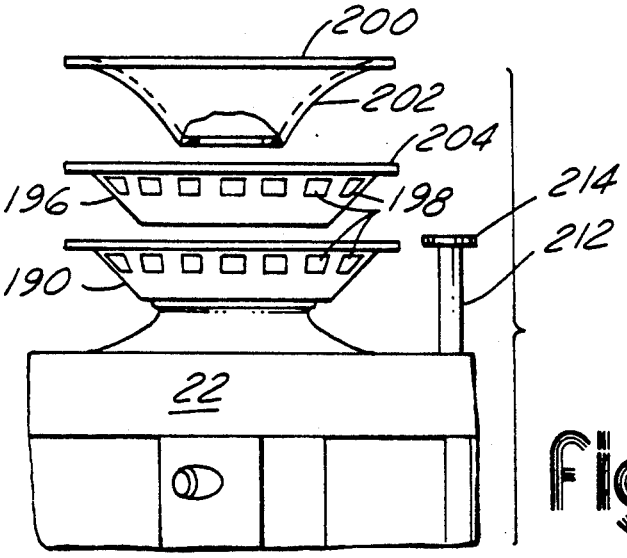
Fig-18

INTERNAL COMBUSTION ROTARY ENGINE HAVING A STACKED ARRANGEMENT OF CYLINDERS

TECHNICAL FIELD

This invention relates to an internal combustion rotary engine and, in particular, to an internal combustion rotary engine having a stacked arrangement of cylinders in a plane on top of another set of cylinders in a parallel plane.

BACKGROUND OF THE INVENTION

Reciprocating piston engines are well known in the prior art, the most common having a rotating crankshaft with off-set eccentric surfaces to which the pistons are connected for their reciprocation. Usually, there is a piston rod for each piston that connects the piston to the eccentric surface. This arrangement is commonly found in the well known V-8, straight 6 and 4 cylinder engines used in automobiles and boats. There are also the usual camshafts and valves, spark plugs and an ignition system. One of the problems with this arrangement is that the engines mentioned require the size of the engine block to be long enough to handle at least four pistons in a line. Considering that a single piston is about three inches or more in diameter, when multiplied by four and then adding in the cylinder size plus a cooling jacket surrounding each cylinder, the block will measure twenty inches or more. Engines of this size take a lot of space in an engine compartment.

Also, the conventional V-8 and straight 6 and 4 cylinder engines have been inefficient for their size and weight.

It is also known that rotary engines use radial placement of the pistons around a crankshaft with eccentric surfaces, require less space, and have fewer moving parts. Commonly, the pistons are connected to the crankshaft by piston rods. This type of engine does not require long crankshafts since there are generally four pistons radiating from the crankshaft and in the same plane. Most rotary engines have four pistons positioned 90 degrees apart, and a few have more. There are a few fluid motors which have two banks of four pistons stacked and connected to the same crankshaft. Two examples of this stacked arrangement are shown in U.S. Pat. Nos. 1,488,528 and 2,709,422. When pistons are arranged in a radial pattern and are 90 degrees apart, the pistons 180 degrees apart are often referred to as opposed pistons.

One of the difficulties with radial or opposed piston engines is providing an intake valve system to supply an air or a fuel/air mixture to the cylinders as needed. The usual intake valve and manifold arrangement with a camshaft to open and close the intake valves does not appear to be the answer, since the valves would have to be mounted on each head along with an overhead cam, adding substantially to the engine size and weight. One valve system of interest is shown in U.S. Pat. No. 3,584,610, where the intake valves extend coaxially through the pistons and includes valve stems carrying slotted guides and tension springs. A lobed cam moves the piston and intake valve against the valve closing force of the spring to open the valve to admit ignition gases to the combustion chamber. A similar type of piston with an intake valve is shown in U.S. Pat. Nos. 1,010,754 and 1,580,720. In the patents cited, the fuel or fuel/air mixture are pumped into the crankcase where the crankshafts and other moving parts are located. Such a crankcase design does not provide proper lubrication of these moving parts, where high revolutions require the shaft bearings and the reciprocating pistons to be well lubricated to reduce wear. To avoid the use of overhead cams, rocker arms, etc., which make up the well known assembly or the intake valve-in piston arrangement with poor crankcase lubrication, a different valve system is needed. The present invention addresses this need.

SUMMARY OF THE INVENTION

The primary object of the invention is to provide an engine that is of light weight, smaller without sacrificing horsepower, and having an improved valve system. This object also takes advantage of a piston arrangement where the pistons are in contact with a rotary crankshaft without being connected to it.

The invention relates to an internal combustion rotary engine, and in particular to an internal combustion rotary engine having a stacked arrangement of cylinders in a plane on top of another set of cylinders in a parallel plane.

Disclosed is an engine block of smaller dimensions than the known blocks with four cylinder blocks and heads spaced about 90 degrees apart around the engine block. The disclosed engine block has a crankcase in which a crankshaft rotates. Lobes of the crankshaft are mounted on the crankshaft parallel to one another to create two eccentrics circumferentially spaced apart to counteract any vibrations that would be present if parallel eccentrics are moving together.

In one embodiment, the engine block is structured to handle two rows of four cylinders with corresponding pistons. The pistons freely reciprocate in their respective cylinders, riding on one of the eccentric lobes in one direction and being subject to fluid pressure in the other. Each piston has a stationary piston rod with an eccentric engaging end that is constantly in contact with the associated lobe.

The cylinder heads house a valve system that does not include tappet valves commonly found in internal combustion engines. The valves include a rotary tube with ports that open once every revolution to supply a fuel/air mixture to each cylinder. Each rotary valve has two sets of ports, one set for a cylinder in one row of cylinders, and the other set of ports for a cylinder in the other row of cylinders. In one embodiment, the two sets of ports are arranged 135 degrees off-set. As one set is supplying a fuel/air mixture, the other set is closed. The pistons and rotary valves are positioned so that as the fuel/air mixture or air is supplied to one piston, the opposed piston is fully extended in its cylinder (FIG. 2). This compresses a fuel/air mixture at the same time as the piston clockwise of the piston supplied with fuel moves inward under the force of ignited fuel. The piston opposed to the inwardly moving piston moves outward in its cylinder, expelling exhausted fuel. Having multiple rows, or banks of cylinders and phasing the engine operation such that when a piston in one row is receiving a fuel supply, the opposed piston in another row is also receiving a fuel supply. These pistons are moved inwardly by the forces of ignition.

In the preferred embodiment, the fuel system includes a fuel injection system which injects pressurized fuel through fuel injectors directly into the cylinders. A ram air blower pressurizes air and directs it to the rotating valves for distribution to the cylinders. The fuel injection pump is connected to a gear system, which rotates the ram air blower to turn a camshaft. Cam followers pivoted by the cams actuate spring tensioned plungers which force fuel through injection lines to the fuel injectors.

BRIEF DESCRIPTION OF THE DRAWINGS

FIG. 16 is a section view taken along the line 16—16 of FIG. 15;

FIG. 17 is a perspective view of a ram air cowling with a metering air system;

FIG. 18 is a exploded partial side view of the rotary engine with a ram air cowling and metering air system;

FIG. 19 is a fragmentary cross-sectional view of the metering air system shown assembled;

FIG. 20 is a top view of a valve seat of the invention; and

FIG. 21 is a side elevational view of a valve seat of FIG. 20.

DESCRIPTION OF THE INVENTION

Figure 1:
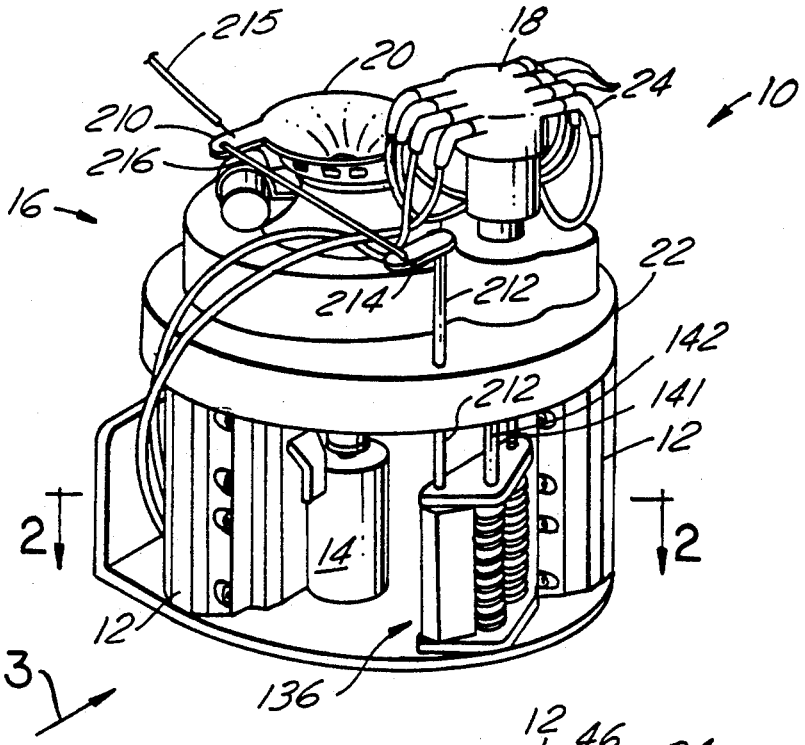
FIG. 1 is a perspective view of a rotary engine of the invention.
Figure 2:
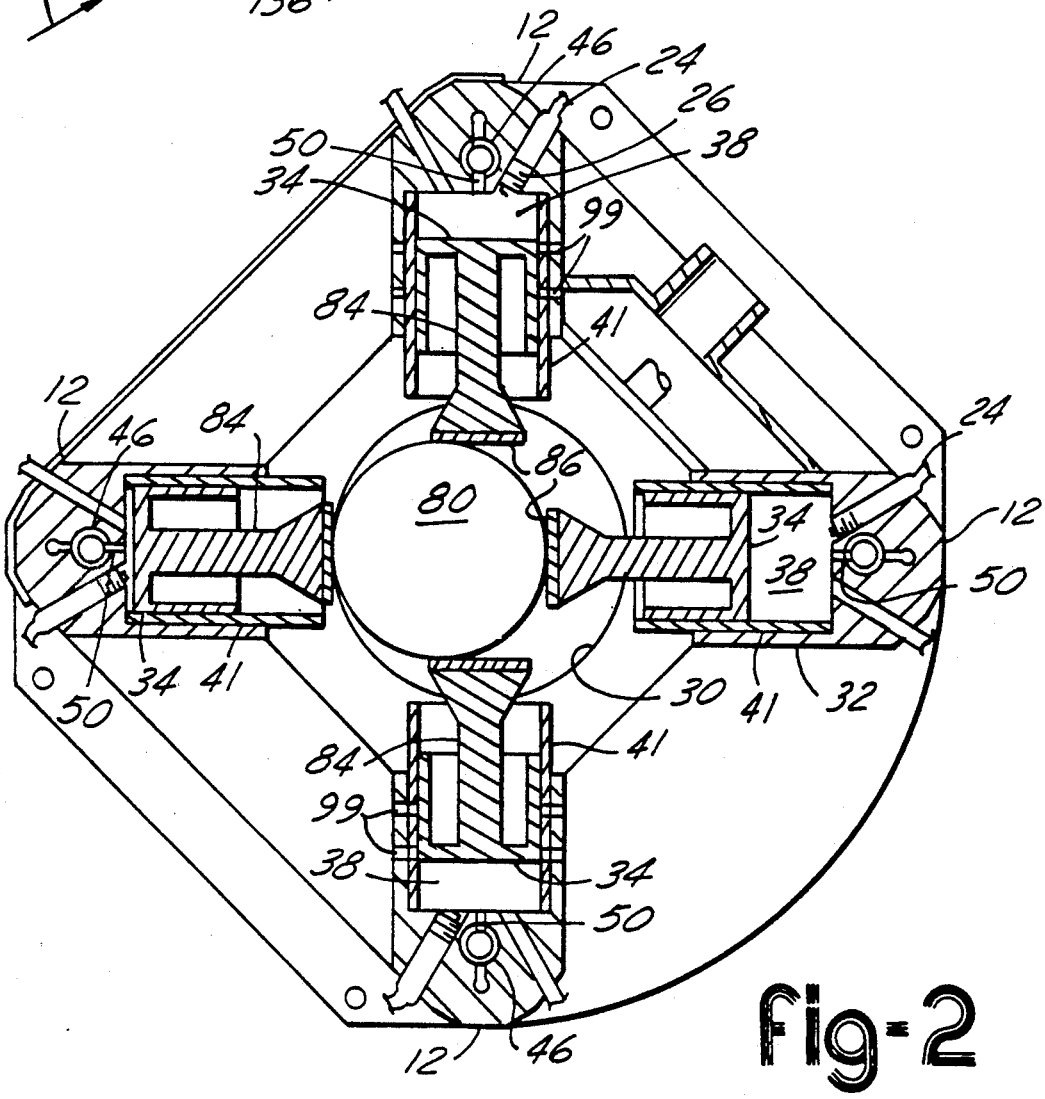
FIG. 2 is a cross-sectional view taken along the line 2—2 of FIG. 2.

Referring to FIGS. 1-16, there is shown a rotary engine 10 according to the present invention. The embodiment depicted in FIG. 1 discloses a rotary engine 10 with two of its four cylinder heads 12 showing, a starter 14, and a top end assembly 16. The top end assembly 16 includes a distributor 18, and a carburetor 20 mounted on a ram air cowling 22. Distributor 18 includes the usual electronic ignition well known in the automotive art, and ignition wires 24 connected to spark plugs 26 (FIG. 2). Air metering system 20 will be fully described below in the discussion of FIGS. 17-19.

Rotary engine 10 has an engine block with a center bore 30 (FIG. 2). There are cylinders 32 in the block radiating from bore 30. In the embodiment depicted, such cylinders are approximately 90 degrees apart, but the invention is not so limited. Each cylinder 32 houses a piston 34 which reciprocates. Four cylinder heads 12 occlude the cylinder combustion chambers 38. Cylinder head 12 covers a pair of cylinders in adjacent rows, or banks, shown best in FIG. 3. Between the cylinder heads 12 and the engine block is an exhaust port block 36 (FIG. 10) which has cylinder bores 40 that form part of the cylinder head 12. A pair of exhaust ports 45 extend from cylinder bore 40 to outside surface 43 of the exhaust port block 36. Each cylinder head 12 has a cylinder sleeve 41 to provide a close fitting surface for each associated piston 34. The sleeves 41 are removable when a loose or seized fitting relationship between a cylinder and piston exists.

Figure 9:
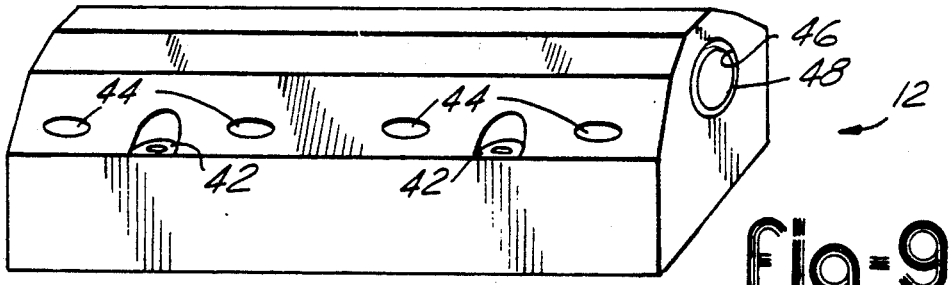
FIG. 9 is a perspective view of a cylinder head of the invention.
Figure 10:
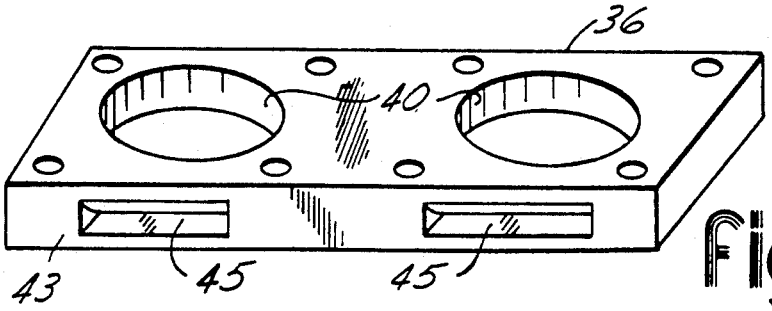
FIG. 10 is a perspective view of an exhaust block of the invention.

A cylinder head 12 as shown in FIGS. 2 and 9 has spark plug ports 42 and bolt holes 44. A longitudinal bore 46 extends through the cylinder head 12. Bore 46 has a sleeve 48, preferably of bronze, pressed into it and forms a bearing surface. A pair of slots 50 extend through sleeve 48 and from longitudinal bore 46 to combustion chamber 38. Fitted in longitudinal bore 46 is a rotary valve 52, best shown in FIGS. 4 and 6. The rotary valve 52 is a cylindrical tube with a closed end 53 and an open end 55 and having, in the preferred embodiment, a first set of ports 54 and a second set of ports 56. Each of the cylinder heads 12 covers a cylinder pair where one of the cylinders is one of a bank of, for example, four cylinders in a single plane radiating from crankcase bore 30. The other cylinder pair is one of the second banks of, for example, four cylinders in another parallel plane. One set of ports 54 is in contact with the combustion chamber of a cylinder in one bank and another set of ports 56 is in contact with the combustion chamber of a cylinder in the other bank. Therefore, as the rotary valve 52 rotates in sleeve 48, one set of ports 54 opens to align with one of the slots 50 to admit a fuel and air mixture at the same time the other set of ports 56 is closed. The ports 54 are 180 degrees out of phase with ports 56 when there are two banks.

Figure 14:
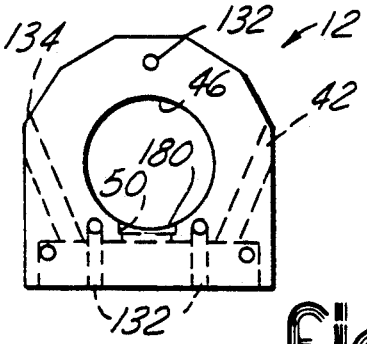
FIG. 14 is an end view of another embodiment of a cylinder head of the invention.

In FIGS. 20 and 21, a different type of bearing plate 180 for the rotary valves 52 is shown. In place of the sleeve 48, the bearing plate 180 is pressed into cylinder head 12 and, in particular, slots 50. FIG. 14 shows bearing plate 180 pressed into slots 50 through longitudinal bore 46. Plate 180 has an arcuate bearing surface 182 (FIG. 21), which conforms to the diameter of bore 46 and to the exterior diameter of rotary valve 52. There are two ports 184 which extend through the plate 180 to connect valve 52 with the combustion chamber 38 of cylinders 32. Bearing plate 180 has an undercut 186 around the exterior periphery 180 to provide a ridge 188 that seats in a groove (not shown) in cylinder heads 12.

Figure 4:
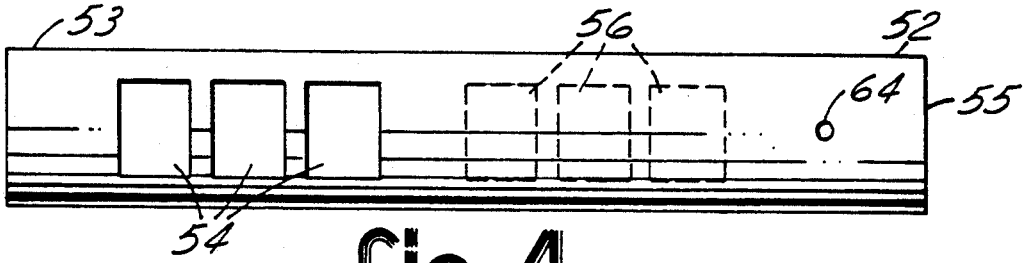
FIG. 4 is a front view of a valve of the invention.
Figure 5:
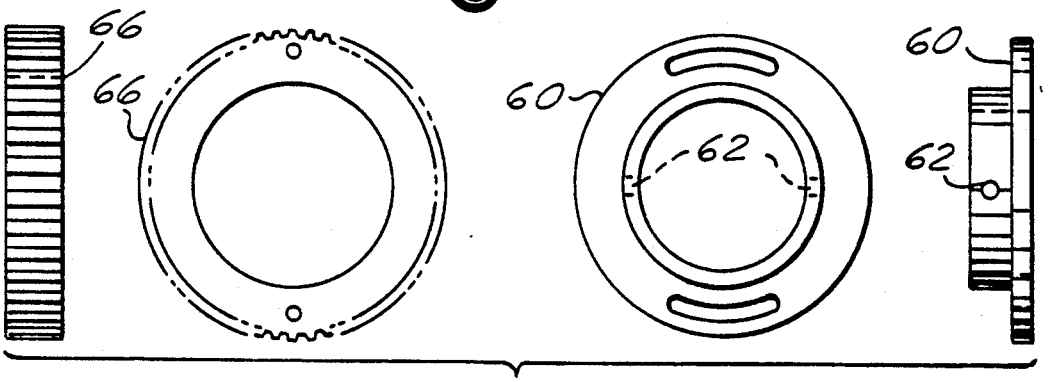
FIG. 5 is a exploded view of a valve gear of the invention.
Figure 6:
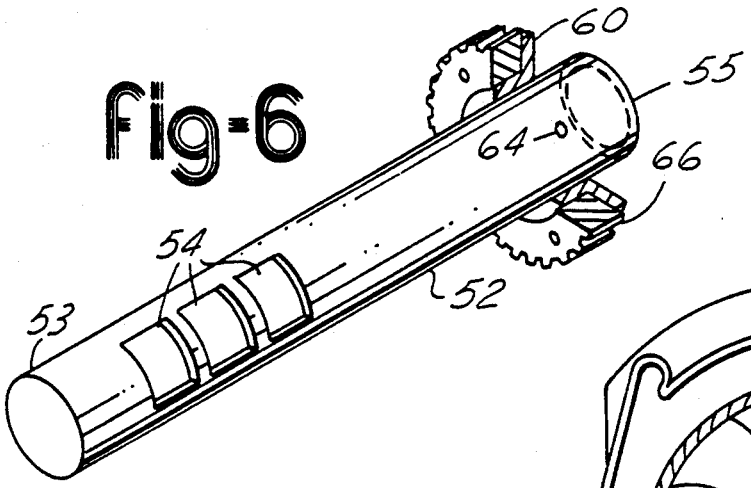
FIG. 6 is a perspective view of the valve.

The open end 55 of the rotary valve 52 has a gear assembly 58 mounted on it (FIGS. 5,6). There is a ring 60 with set screw holes 62 to align with similar set screw holes 64 on the rotary valve. A set screw, not shown, fastens ring 60 to the rotary valve 52 via holes 62 and 64 (FIG. 4). A ring gear 66 attaches to ring 60 and extends beyond cylinder head 12 where a gear system 68 (FIG. 8) rotates gear 66 and, consequently rotary valve 52.

Gear system 68 has a drive gear 70 and four intermediate gears 72 which connect ring gears 66 to drive gear 70. Drive gear 70 is attached to a crankshaft 74 for rotation. A distributor gear 76 is driven by drive gear 70 to rotate the distributor rotor. The engine starter 14 connects to the gear system 68 via gear 78 to turn the entire gear system and crankshaft 74 to start the engine 10. The starter 14 has an override to disengage the starter once the engine is running.

Figure 3:
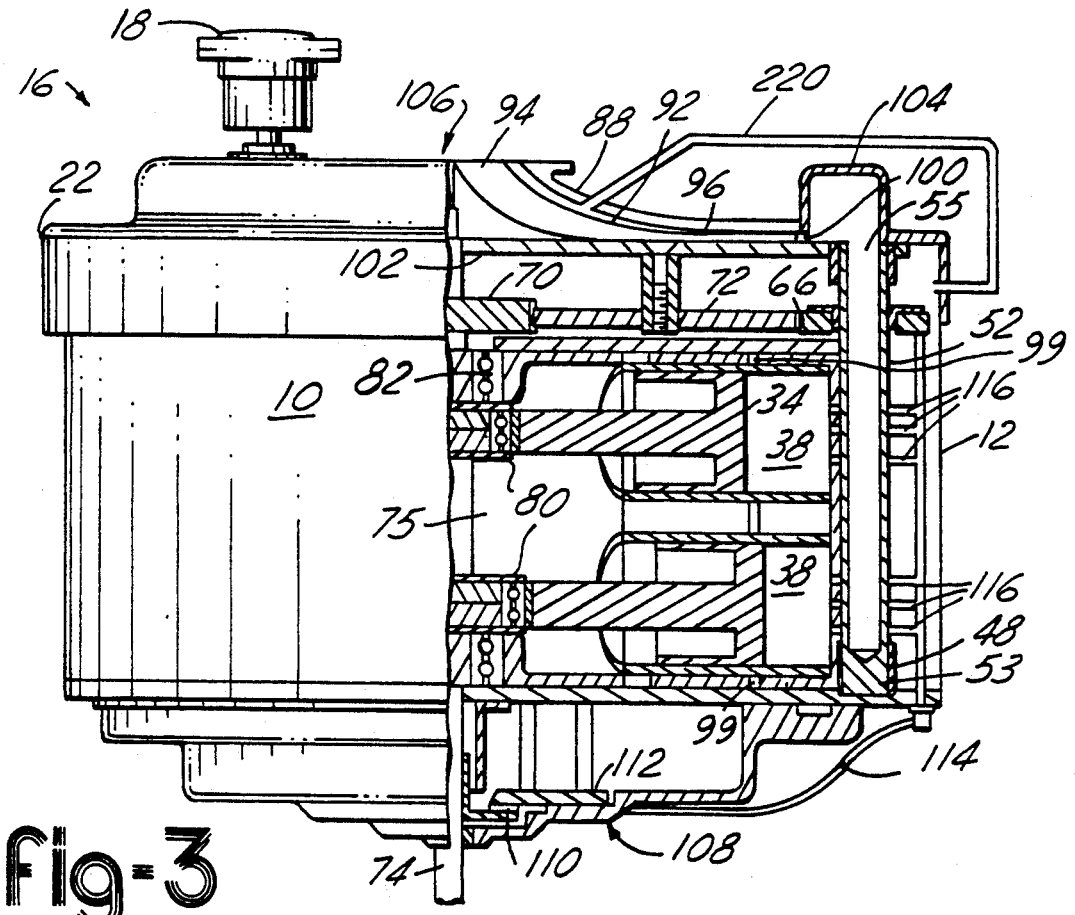
FIG. 3 is a partial view in the direction of arrow 3 with parts broken away of FIG. 1.

Crankshaft 74 is shown in FIG. 3 with a pair of eccentric cams 80. One end of the shaft 74 is connected to the gear system 68, and the other end is the output end which connects to a transmission. The crankshaft 74 is supported on main bearings 82 in crankcase 30. Pistons 34 have stationary piston rods 84 with enlarged lands 86 that ride on the surfaces of the eccentric cams 80. As the crankshaft 74 rotates, one of the eccentric cams 80 controls the outward movement of the pistons 34. Inward movement of each piston is controlled by pressure generated by a ram air blower 88, which will be explained. The combustion chamber 38 of each piston and cylinder sets is either in a state of being charged with a high pressure fuel/air mixture, further compressing the mixture, expansion of the ignited mixture, or exhausting the spent mixture. In the situations where the combustion chamber is charged and the mixture is ignited, there is a force on the piston face which presses the land 86 against the eccentric cam 80. In the other situations where the mixture is compressed or exhausted, the eccentric cam 80 forces the piston outward to compress the mixture, or to expel the exhaust mixture through exhaust valves 99 in the cylinder sleeve 32. The opening and closing of the exhaust valves is not shown. In FIG. 2, an exhaust manifold is shown to remove exhaust.

The carburetor 20 serves as an air metering system 21 as best shown in FIGS. 7 and 17–19. To supply air for the engine, air is drawn into the engine through the air metering system 21 by the ram air blower 88. Mounted on the ram air cowling 22, the air metering system 21 includes a collar 190 that is formed with cowling 22. Collar 190 is tapered with a center opening throat 192 extending into the engine. The larger end 194 of collar 190 has a rim for supporting a rotatable plastic collar 196. The exterior of collar 196 is similar to the interior of collar 190, so that as collar 196 rotates it is in close contact with the interior of collar 190 shown best in FIG. 19. Each of the collars 190 and 196, respectively, has ports 198 which cooperate to open and close to form a valve to admit and stop the flow of air. Collar 196 is tapered and is open at its top and bottom.

Covering collar 196 is a frusto conical cone-shaped cover 200. There is a cone-shaped wall 202 with an arcuate curve which is designed to direct the air drawn into the air metering system into the ram air blower 88. Air is drawn through the ports 198 of collars 190 and 196 where it impinges against the arcuate curve of wall 202, to be directed to throat 192. Cover 200 can be bonded to the rim 204 of collar 196 to form a seal between the edges of the cover and collar, as shown in FIG. 19, where arrows show the air flow. To protect the internal moving parts of the opening from moisture, dirt and dust, an air filter, not shown, is wrapped around the exterior of collar 190. There may also be an air filter canister housing the air filter.

To rotate collar 196, there is a lever 210 (FIG. 17) connected to rim 204 and a pivotal rod 212 extending from ram air cowling 22. A second lever 214 is mounted on rod 212 and connected to lever 210 by a link 215. A throttle cable 216 connected to lever 210 moves collar 196 to open and close ports 198, thereby adjusting the amount of air drawn into the engine. Pivotal rod 212 extends through ram air cowling 22 and is attached to the fuel inlet of a fuel injection pump 136 to adjust the fuel flow to pump 136, thereby providing a proper air-fuel mixture in the cylinders.

Figure 7:
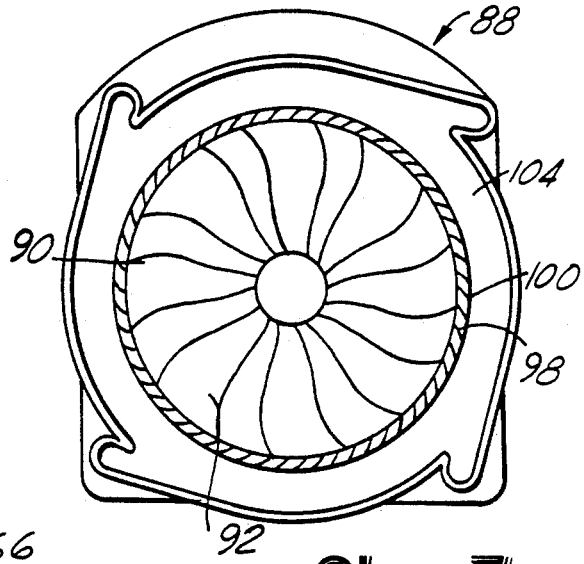
FIG. 7 is a bottom view of a ram air blower of the invention.
Figure 8:
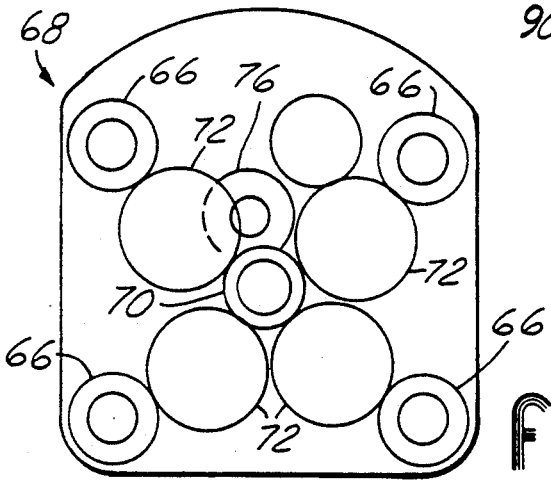
FIG. 8 is a schematic of a gear system of the invention.

Turning to the ram air blower 88, in FIGS. 3 and 7 there is a driven vane propeller 90 with arcuately-shaped air capturing and pressuring vanes 92. A side view of vane 92 shows a large air capturing face 94 and a small pressurizing face 96. The vane 92 tapers from capturing face 94 to the pressurizing face 96. Therefore, as the captured air is forced along the vane 92, it is compressed until it reaches the end of the pressurizing face 96, where it is pushed through a circular stationary vane 98 having angled vanes 100 (FIG. 7). The blower 88 is enclosed in a ram air cowling 22, which is contoured to cooperate with vanes 92 and an end plate 102 to aid in pressurizing the air. Beyond the blower 88, the cowling 22 has a small expansion chamber 104 leading to a rotary valve 52 and the open end 55. A carburetor 20 (not shown) is mounted on an inlet opening 106 of the ram air blower 88. A fuel pump, not shown, delivers fuel to the carburetor 20 where the fuel mixes with air and is then introduced to the ram air blower.

FIG. 3 shows the output shaft 74 and an oil pump assembly 108. Rotary engine 10 is suited for operation with the output shaft 74 in a vertical position which allows gravity return of lubricating oil to the oil pump assembly 108. There are pump impellers 110 mounted on the shaft 74 which cooperates with an impeller plate 112 to force lubricating points 116 to provide lubricant to the moving parts.

In use, a fuel and air mixture is supplied to the cylinder combustion chambers during their charging stroke, which is timed to the opening of the rotary valves 52. The starter 14 begins reciprocating the crankshaft 74, pistons 34, gear system 68 and rotary valves 52. Distributor-controlled spark plug firing ignites the compressed fuel/air mixture that has been compressed in the proper combustion chamber to force the piston 34 against the eccentric cam 80 to continue the rotation of the crankshaft 74 and reciprocation of the pistons 34. Pressurized fuel/air mixture delivered from the ram-air blower 88 to the combustion chambers 38 applies a force to the face of the pistons to reciprocate the pistons inward, and maintain contact of the piston lands 86 with eccentric cams 80. The opening and closing of the intake valves 52 and exhaust valves 99 are timed to synchronize with reciprocation of the pistons. To draw a vacuum in crankcase 75, a vacuum line 220 is connected between ram air blower 88 and the crankcase.

Figure 11:
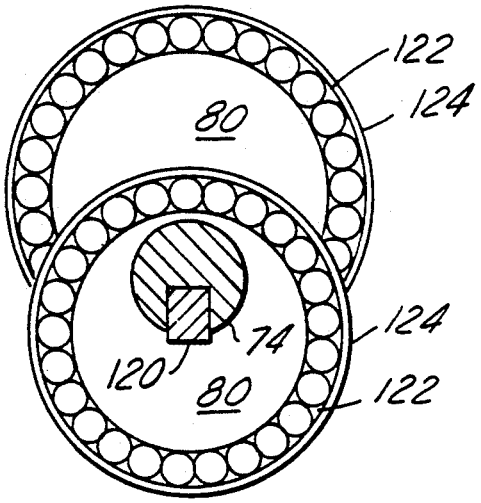
FIG. 11 is an end view of a crankshaft of the invention.
Figure 12:
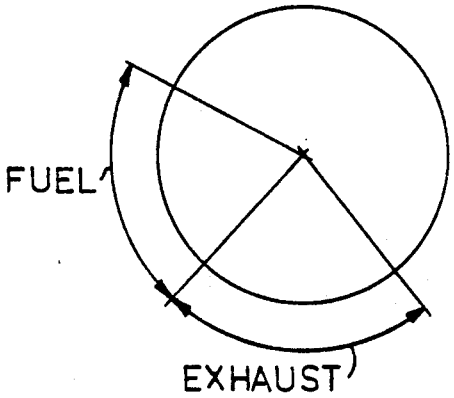
FIG. 12 is a schematic of the valve opening and the exhaust valve opening.

In the preferred embodiment, rotary engine 10 is equipped with two rows, or banks, of four rotary pistons. Therefore, there are two eccentric cams 80 keyed to crankshaft 74 by key 120 (FIG. 11). Each eccentric cam 80 has a bearing race 122 with a bearing ring 124 for contacting the associated piston land 86. The opening and closing of the intake valves 52 and exhaust valves 99 are timed so that the intake valves in one bank are open in a combustion chamber. Simultaneously, the exhaust valves are closed to the same chamber and the intake valves in the other bank, controlled by the same rotary valve 52, are closed to the adjacent combustion chamber, and the exhaust valves are open, as represented in FIG. 12.

A fuel injection system 136 is used to feed pressurized fuel to each cylinder (FIG. 14). Cylinder head 12 has a longitudinal bore 46 and a pair of slots 50, one shown, for sending pressurized air to the cylinder combustion chamber. There is a spark plug port 42 and oil ports 132 which connect to the oil lubricant line 114 (shown in FIG. 3). Oil ports 132 extend through the head 12 to connect to oil ports in the engine block to lubricate the pistons 34 and other moving parts. Cylinder head 12 has fuel injector ports 134 which open into the cylinder combustion chamber 38.

Figure 13:
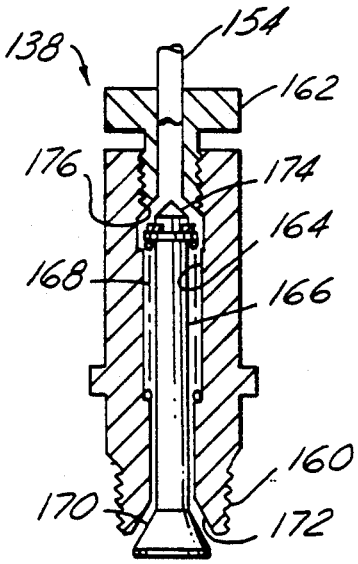
FIG. 13 is a cross-sectional view of a fuel injector of the invention.
Figure 15:
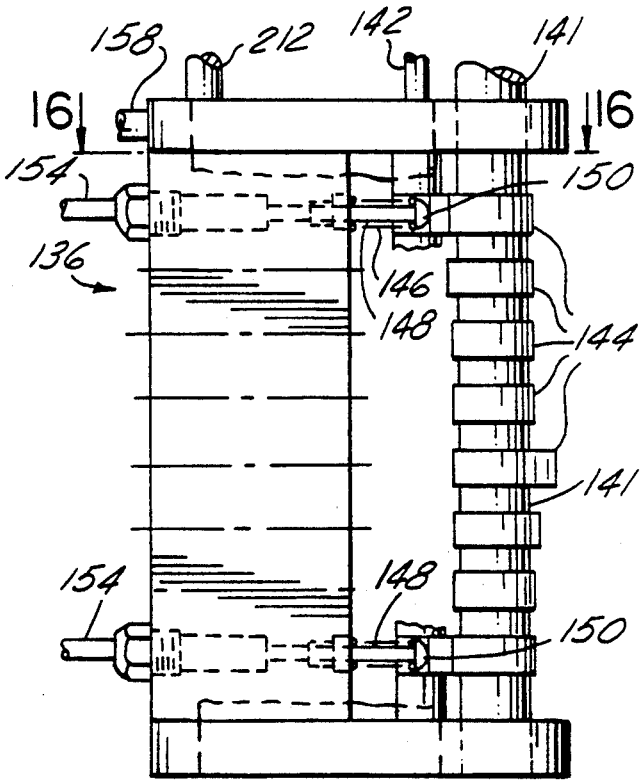
FIG. 15 is a side view of an injector pump of the invention.

The fuel injection system 136 includes an injection rail 136 and fuel injectors 138 (FIG. 13). Fuel injection rail 136 includes a rotating camshaft 141 which connects to gear system 68 of FIG. 8. The fuel injection rail 152 has a plurality of rocker arms 140, two shown, which is pivotable on a pivot rod 142. Rocker arm 140 is pressed against cam lobe 144 by spring tension from spring 146. A push rod 148 with a follower 150 is pressed against the rocker arm 140 by spring 146 so that any pivoting of rocker arm 140 is transmitted to push rod 148, which reciprocates in and out of fuel rail 152. There is a plunger end 156, integral with push rod 148 in communication with an injection line 154 to force fuel under pressure through the line. In one embodiment, there are eight such injection lines 154, running from rail 152 to fuel injectors 138 mounted in cylinder heads 12. Rail 152 has a fuel connection port 158, to which a fuel line from a fuel pump, not shown, and a fuel supply, also not shown, are connected. Fuel port 158 is connected to fuel circulating lines in rail 152 to connect all of injection lines 154 to the fuel supply.

Fuel injector 138 has a threaded end 160 and a screw in connector 162 which connects fuel line 154 to the injector. There is a bore 164 extending through the injector 138 to supply fuel to the combustion chamber. A spring-biased plunger 166 is mounted in bore 164 to shut off the fuel supply when the pressure is below a predetermined level. Spring 68 controls the opening and closing of plunger 166. Plunger 166 has a flared end 170 which mates with a frusto-conical tapered bevel 172 in threaded end 160. The top end 174 of plunger 166 has a conical shape to mate with a beveled surface 176 in screw-in connector 162.

Fuel from injector rail 152 is under pressure as it enters the fuel injector 138 to open a space between the mated top end 176 and the plunger top 174 end. Also, fluid pressure opens a space between plunger flared end 170 and tapered bevel 172 in threaded end 160 against the force of spring 168.

Using a fuel injection to replace a carburetor also means that only air is pressurized by ram air blower 88 and rotary valves 52 are used to add air to the combustion chambers 38. The fuel is atomized when it enters the combustion chambers to commingle with the pressurized air, thus making ignition by electric spark more explosive. The pressurized air is used to apply force to the face of the pistons to keep them in contact with crankshaft lobes 80.

What is claimed is:

1. An internal combustion engine comprising:

an engine block having a crankcase bore and one or more cylinders in said block; .

said one or more cylinders being positioned radiating from said crankcase bore;

a crankshaft in said crankcase bore having at least one eccentric cam where said crankshaft rotates about a center axis through said crankshaft bore;

a plurality of pistons in each of said one or more cylinders, each of said pistons having a piston rod extending from said piston, said fixed piston rod engaging said at least one eccentric cam;

a plurality of cylinder heads mounted on said engine block to cover said one or more cylinders, each of said cylinder heads having a longitudinal bore with a slot for communication with said one or more cylinders;

a valve mounted in said longitudinal bore, the bore having at least one set of ports for opening and closing off communication with said one or more cylinders;

means for rotating said valve for opening and closing said ports in a timed relationship with reciprocation of said pistons;

means for supplying pressurized air to said valve, the pressurized air applying a force to said piston to move said piston inwardly toward said crankshaft, the means for supplying pressurized air mixing air with fuel in said one or more cylinders;

means for supplying fuel under pressure to said one or more cylinders; and said means for rotating said valve and said means for supplying pressurized air being connected to said crankshaft.

2. An internal combustion engine as in claim 1 wherein said engine block has two banks of cylinders parallel to each other, said free-piston means in said cylinders contacting a pair of eccentric cams where said cams are offset 135 degrees from each other, and said plurality of cylinder heads each cover two cylinders, one from each of said banks, said valve having two sets of ports with one set over one cylinder and the other over another cylinder spaced 135 degrees apart therefrom.

3. An internal combustion engine as in claim 2 wherein said one or more cylinders are provided with walls, and rotary intake valves, and exhaust ports are located in the walls of said one or more cylinders.

4. An internal combustion engine as in claim 3 wherein each of said valves is timed to sequentially open and close clockwise around said engine block, and where valves in an adjacent bank are 135 degrees out of phase to reduce vibration.

5. An internal combustion engine as in claim 3 including a gear system which rotates a ram air blower to pressurize air and supply it to said valves.

6. An internal combustion engine as in claim 5 wherein said ram air blower has an impeller, said impeller having blades with air capturing means and air pressurizing means, each of said blades having an arcuate shape.

7. An internal combustion engine as in claim 6 wherein said impeller is enclosed in a cowling to trap air between said blade and said cowling.

8. An internal combustion engine as in claim 7 including an oil lubricating pump having an impeller connected to said crankshaft and a stationary impeller plate for directing oil to engine moving parts, where oil is returned by gravity to said pump.

9. An internal combustion engine as in claim 8 wherein said gear system rotates a distributor rotor to provide an electric spark to said one or more cylinders, and to operate a starter to start said engine.

10. An internal combustion engine as in claim 9 including an exhaust plate between said one or more cylinders and said cylinder heads, said exhaust plate defining a slot for removing exhaust gases from said cylinders.

11. An internal combustion engine as in claim 10 including a carburetor which provides fuel to said ram air blower to form a fuel/air mixture.

12. An internal combustion engine as in claim 11 including a fuel injection means which provides fuel to said one or more cylinders.

13. An internal combustion engine as in claim 12 wherein said engine is a rotary engine with opposed pistons in four cylinders, radiating from said crankcase.

* * * * *